US012287116B2

(12) United States Patent
Romero et al.

(10) Patent No.: US 12,287,116 B2
(45) Date of Patent: Apr. 29, 2025

(54) HOUSING FOR A HEATING, VENTILATION, AND/OR AIR CONDITIONING (HVAC) UNIT

(71) Applicant: Johnson Controls Tyco IP Holdings LLP, Milwaukee, WI (US)

(72) Inventors: Elmer Wayne Romero, Oxford, KS (US); Debra S. Yates, Wichita, KS (US); Xianjin Cheng, Andover, KS (US); Stephen C. Szczepanski, Wichita, KS (US); Cole Brennan Morrow, Derby, KS (US)

(73) Assignee: JOHNSON CONTROLS LIGHT COMMERCIAL IP GMBH, Schaffhausen (CH)

( * ) Notice: Subject to any disclaimer, the term of this patent is extended or adjusted under 35 U.S.C. 154(b) by 40 days.

(21) Appl. No.: 17/732,183

(22) Filed: Apr. 28, 2022

(65) Prior Publication Data

US 2022/0349616 A1 Nov. 3, 2022

Related U.S. Application Data

(60) Provisional application No. 63/182,269, filed on Apr. 30, 2021.

(51) Int. Cl.
*F24F 13/20* (2006.01)
*F24F 13/22* (2006.01)
*F24F 13/30* (2006.01)

(52) U.S. Cl.
CPC ..... *F24F 13/20* (2013.01); *F24F 13/222* (2013.01); *F24F 13/30* (2013.01); *F24F 2221/32* (2013.01)

(58) Field of Classification Search
CPC ..... F24F 13/20; F24F 13/30; F24F 13/0209; F24F 2221/32; F24F 1/56; F28F 2275/08;
(Continued)

(56) References Cited

U.S. PATENT DOCUMENTS 4,288,115 A * 9/1981 Sullivan ..... F24F 13/0209 285/424
5,316,165 A * 5/1994 Moran, Jr. ..... H02B 1/40 229/165

(Continued)

FOREIGN PATENT DOCUMENTS

WO WO-2019079833 A1 * 5/2019 ..... B21D 19/08
WO WO-2022021595 A1 * 2/2022 ..... F24F 1/029

OTHER PUBLICATIONS

WO-2019079833-A1 English Translation (Year: 2019).*
WO-2022021595-A1 English Translation (Year: 2022).*

*Primary Examiner* — David J Teitelbaum
*Assistant Examiner* — Devon Moore
(74) *Attorney, Agent, or Firm* — Fletcher Yoder, P.C.

(57) ABSTRACT

A housing for a component (e.g., a heat exchanger) of a heating, ventilation, and/or air conditioning (HVAC) system is disclosed that includes one or more attachment flanges and/or one or more support flanges that are integrated into the housing. The disclosed housing reduces or completely eliminates the use of separate brackets and fasteners when installing components within the housing and/or when coupling the housing to other components of the HVAC system. By dramatically reducing or eliminating these separate components, the disclosed housing designs reduce the likelihood for installation errors, as well as delays due to misplaced brackets and/or fasteners during installation. Accordingly, the disclosed housing designs enable a cost-effective solution for reducing the cost and complexity of installing HVAC system components.

4 Claims, 12 Drawing Sheets

(58) Field of Classification Search
CPC ..... F28F 2275/14; B21D 19/00; F25D 2323/061; B65D 1/225
USPC ..... 220/6
See application file for complete search history.

(56) References Cited

U.S. PATENT DOCUMENTS

| | | | | |
|---|---|---|---|---|
| 6,311,735 | B1 * | 11/2001 | Small, Sr. | F16L 9/003 138/119 |
| 6,523,575 | B1 * | 2/2003 | Mrsny | F16L 9/22 138/155 |
| 2007/0170827 | A1 * | 7/2007 | Frenia | F24F 1/005 312/265.5 |
| 2016/0003505 | A1 * | 1/2016 | Trotter | F25B 27/007 62/235.1 |

* cited by examiner

HOUSING FOR A HEATING, VENTILATION, AND/OR AIR CONDITIONING (HVAC) UNIT

CROSS-REFERENCE TO RELATED APPLICATIONS

This application claims priority to and benefit of Provisional Application No. 63/182,269, entitled "A HOUSING FOR AN HVAC UNIT", and filed on Apr. 30, 2021, which is hereby incorporated by reference in its entirety for all purposes.

BACKGROUND

The present disclosure relates generally to heating, ventilation, and/or air conditioning (HVAC) systems, and more particularly to housing designs for HVAC units.

A wide range of applications exist for heating, ventilation, and/or air conditioning (HVAC) systems. For example, residential, light commercial, commercial, and industrial systems are used to control temperatures and air quality in residences and buildings. Such systems often are dedicated to either heating or cooling, although systems are common that perform both of these functions. Very generally, these systems operate by implementing a thermal cycle in which fluids are heated and cooled to provide the desired temperature in a controlled space, typically the inside of a residence or building. Similar systems are used for vehicle heating and cooling, and as well as for general refrigeration.

A HVAC system may include one or more HVAC units, and each HVAC unit may include a housing or casing that protects and fluidly isolates certain internal components of the HVAC unit from the external environment. The housing of an HVAC unit may generally include multiple pieces of sheet metal that are coupled together during installation. For example, the housing of an indoor HVAC unit may include multiple sections, such as a first section that encloses a fan of the unit and a second section that encloses a heat exchanger of the unit. During installation, an installer is typically provided with each of the sections of the housing as a kit that includes additional separate pieces, such as mounting brackets and fasteners, that are coupled to the housing sections to enable installation of the interior components of the unit within the housing, and to enable the sections of the housing to be coupled together to form the housing of the unit. However, it is presently recognized that the additional separate pieces of such housing designs can undesirably increase complexity of the installation process, which can lead to installation errors. Additionally, such designs can lead to undue delays as these installation errors are corrected and when these pieces are misplaced during the installation process, increasing installation time and cost.

SUMMARY

In one embodiment of the present disclosure, a housing of a HVAC system includes a plurality of integrated panels, wherein a first panel of the plurality of integrated panels includes an integrated attachment flange that is configured to move from a collapsed configuration to a deployed configuration to couple the first panel of the housing to a component of the HVAC system.

In another embodiment of the present disclosure, a HVAC system includes a heat exchanger unit having a heat exchanger disposed within a housing. The housing includes a plurality of integrated panels, wherein each of the plurality of integrated panels has a respective integrated attachment flange disposed in a respective deployed configuration to couple the heat exchanger unit to a component of the HVAC system, wherein at least two of the integrated panels include a respective integrated support flange configured to support the heat exchanger within the housing of the heat exchanger unit.

In a further embodiment of the present disclosure, a method of installing a housing of a HVAC unit includes positioning the housing adjacent to a component of the HVAC unit, wherein the housing comprises a plurality of integrated panels, and wherein a first panel of the plurality of integrated panels comprises an integrated attachment flange that is initially in a collapsed configuration. The method includes folding a foldable portion of the integrated attachment flange to dispose the integrated attachment flange in a deployed configuration, wherein, in the deployed configuration, at least part of a moveable portion of the integrated attachment flange extends beyond an edge of the first panel to engage the component of the HVAC unit.

Other features and advantages of the present application will be apparent from the following, more detailed description of the embodiments, taken in conjunction with the accompanying drawings which illustrate, by way of example, the principles of the application.

DETAILED DESCRIPTION

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Present embodiments are related to a housing for a component (e.g., a heat exchanger) of a HVAC system that includes one or more attachment flanges and/or one or more support flanges that are integrated into the housing. Present embodiments reduce or completely eliminate the use of separate brackets and fasteners when installing components within the housing and/or when coupling the housing to other components of the HVAC system. By dramatically reducing or eliminating these separate components, present embodiments reduce the likelihood for installation errors, as well as delays due to misplaced brackets and/or fasteners during installation. Accordingly, the disclosed housing designs enable a cost-effective solution for reducing the cost and complexity of installing HVAC system components.

Figure 1:
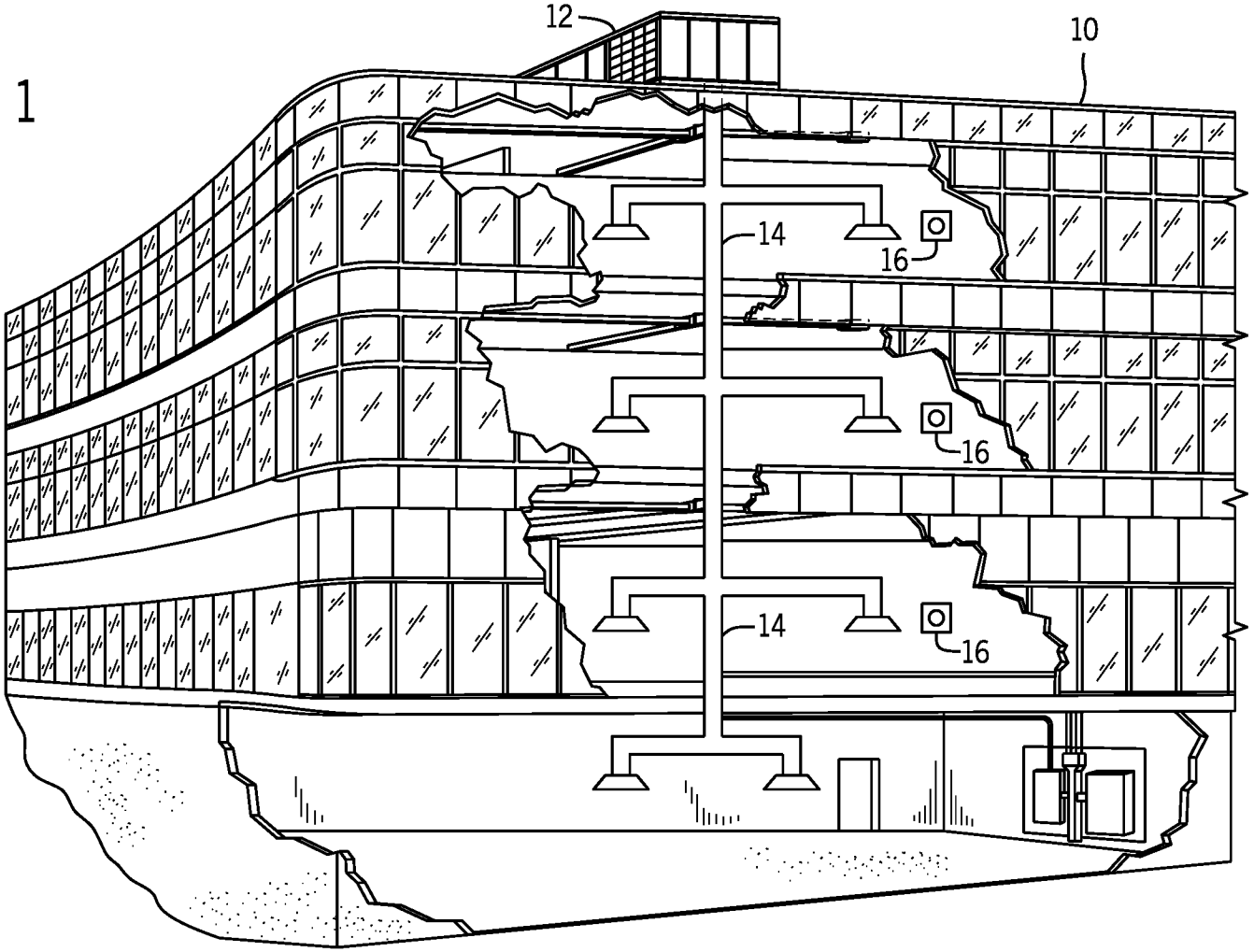
FIG. 1 is an illustration of an embodiment of a building having a HVAC system, in accordance with present techniques.

Turning now to the drawings, FIG. 1 illustrates an embodiment of a heating, ventilation, and/or air conditioning (HVAC) system for environmental management that may employ one or more HVAC units. As used herein, a HVAC system includes any number of components configured to enable regulation of parameters related to climate characteristics, such as temperature, humidity, air flow, pressure, air quality, and so forth. For example, a "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of a HVAC system component, a component configured to enable regulation of climate characteristics, or a combination thereof. A "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes a HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
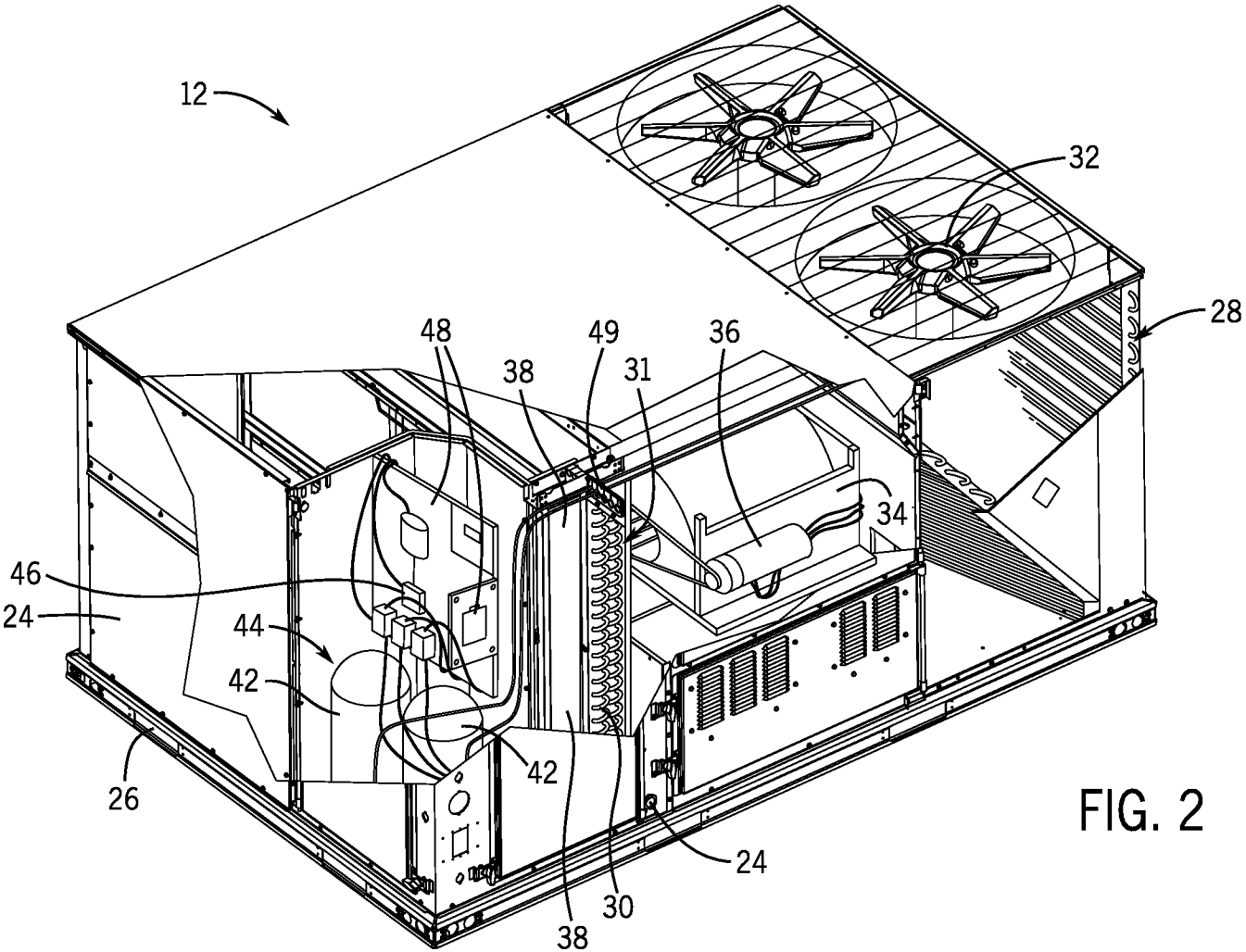
FIG. 2 is an illustration of an embodiment of a split system of the HVAC system, which may be utilized with a residence or the building of FIG. 1, in accordance with present techniques.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, a portion of the cabinet 24 may correspond to the heat exchanger unit housing discussed below. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multi-channel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. In some embodiments, the compartment 31 may correspond to the heat exchanger unit housing discussed below. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
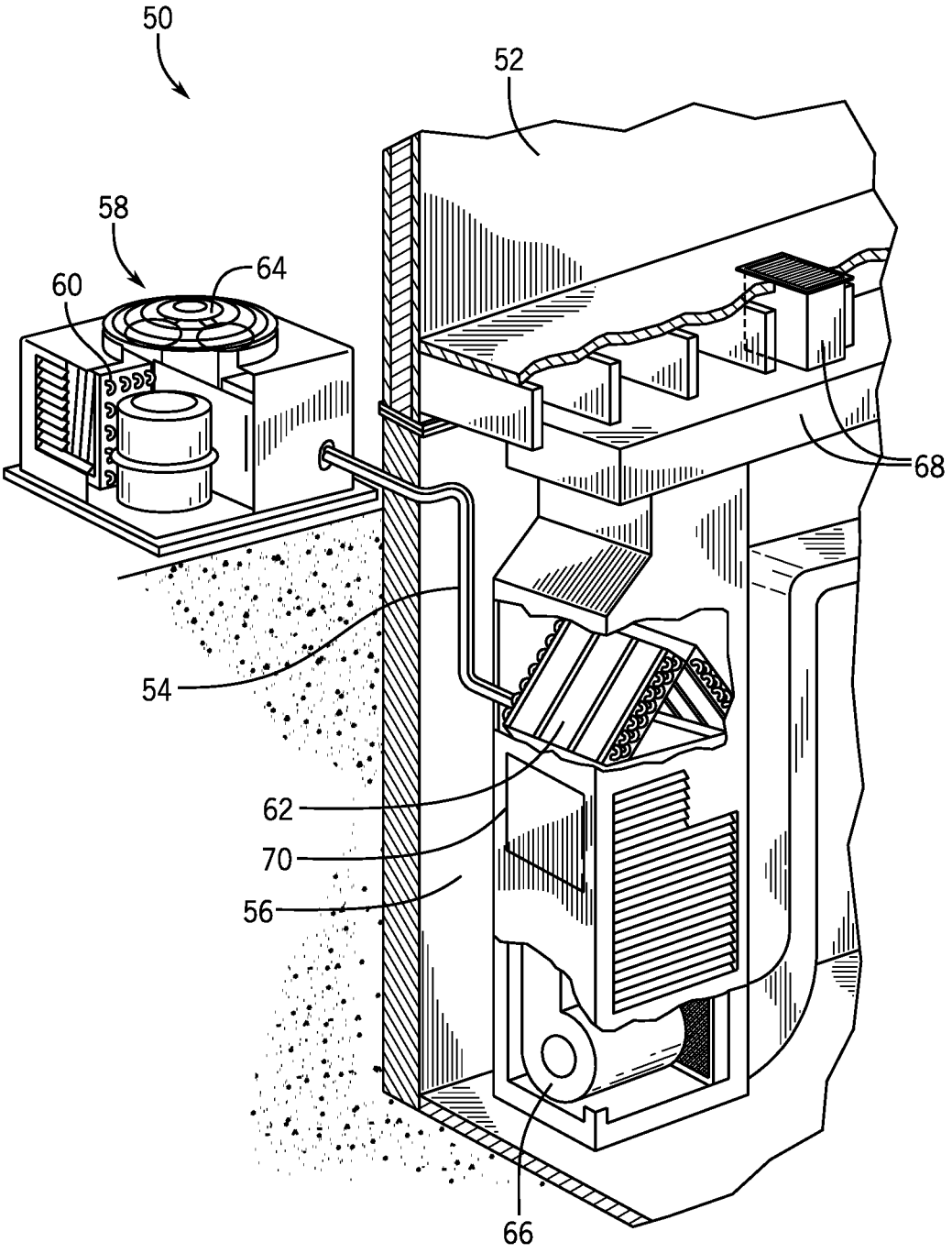
FIG. 3 is a schematic diagram of an embodiment of a refrigeration system of the HVAC system shown in FIG. 1, in accordance with present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
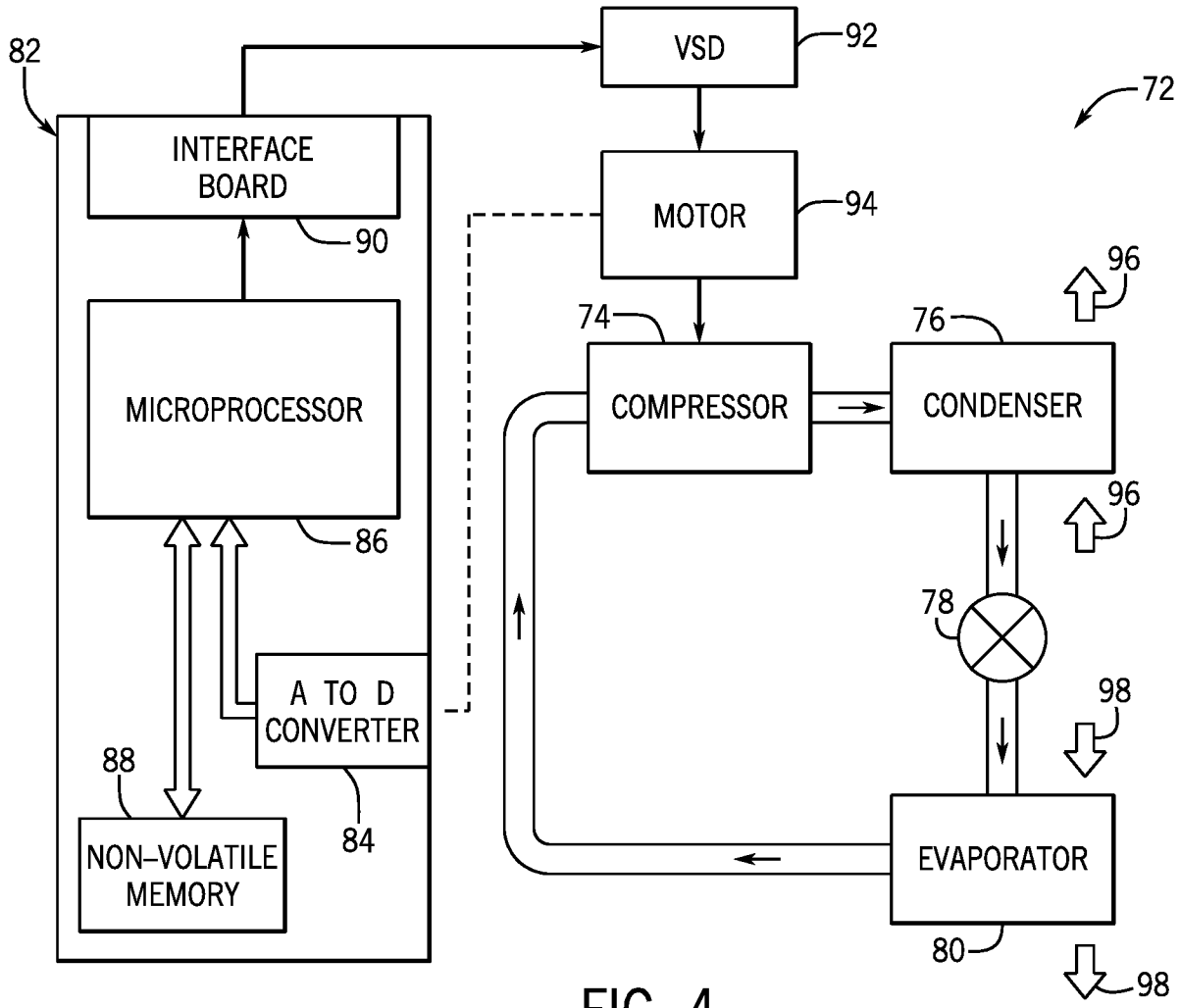
FIG. 4 is a schematic diagram of an embodiment of a vapor compression system of a HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
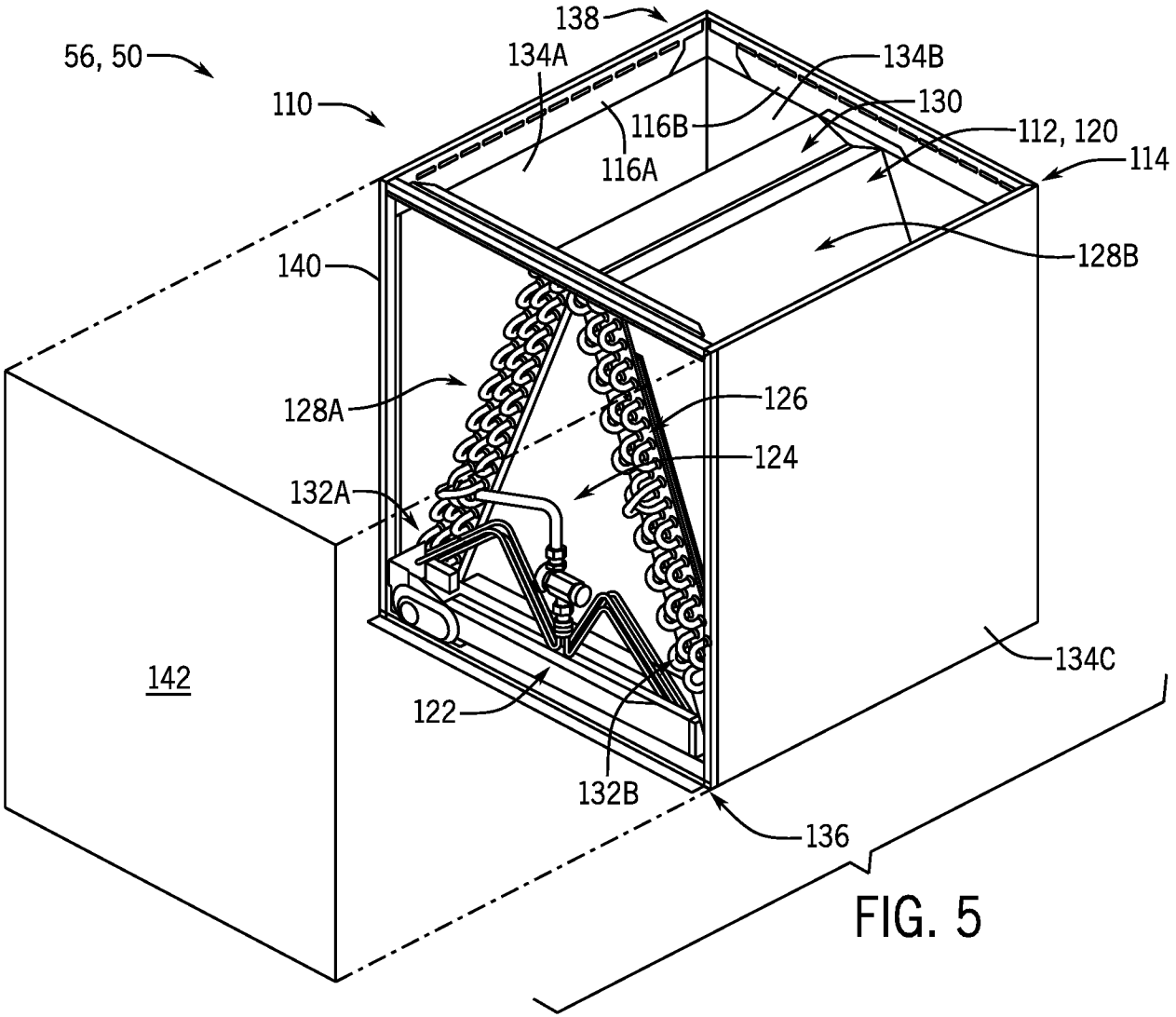
FIG. 5 is a diagram of an embodiment of a heat exchanger unit of a HVAC system having a heat exchanger and a housing that includes attachment flanges and support flanges, in accordance with present techniques.

FIG. 5 illustrates an embodiment of a heat exchanger unit 110 of an indoor HVAC unit 56 of an example HVAC system, such as the residential heating and cooling system 50 discussed above. The heat exchanger unit 110 includes a heat exchanger 112 (e.g., an indoor heat exchanger 62) disposed within an embodiment of a housing 114, which is separately illustrated in FIG. 6. As discussed in greater detail below, the housing 114 includes certain features (e.g., attachment flanges 116) that are integrated into the housing 114 to enable the heat exchanger unit 110 to be coupled to other portions of the HVAC system 50 (e.g., air handling units, ducting, blowers), as well as other features (e.g., support flanges 118) that are integrated into the housing 114 that enable the housing to support at least one internal component (e.g., the heat exchanger 112) of the HVAC system 50. It may be appreciated that, while the presently disclosed techniques are described in the context of the heat exchanger unit 110 of an indoor HVAC unit 56, it is presently recognized that these techniques are applicable to the housing design of any portion of a HVAC system or HVAC unit to reduce cost and complexity during installation. For example, in certain embodiments, the disclosed housing 114 may form a portion of a HVAC system that enables the upward discharge of conditioned air into a conditioned space during colder weather. In another example, the disclosed housing 114 may form a portion of a HVAC system that enables the downward discharge of conditioned air from a roof-top HVAC unit into a conditioned space during warmer weather.

For the embodiment illustrated in FIG. 5, the heat exchanger 112 includes a coil assembly 120, a drain pan 122, and one or more delta plates 124. For the illustrated embodiment, the coil assembly 120 is an A-type coil assembly; however, in some embodiments, other type of coil assemblies (e.g., a V-type, M-type, or N-type coil assembly) may be used. In some embodiments, the coil assembly 120 may be a fin and tube coil assembly that receives chilled refrigerant or other liquid through tubes 126 to condense, cool, and/or dehumidify air that moves across the tubes 126. The illustrated coil assembly 120 includes a first frame portion 128A (e.g., a first coil portion) and a second frame portion 128B (e.g., a second coil portion). The first and second frame portions 128A, 128B meet at an apex 130 of the coil assembly 120, while the distal ends 132A, 132B of the first and second frame portions 128A, 128B are supported by integrated support flanges 118A, 118B of the housing 114. For the illustrated embodiment, delta plates 124 are disposed on front and back sides of the coil assembly 120 between the first and second framed portions 128A, 128B of the coil assembly 120.

During operation of the heat exchanger unit 110, air may be pulled or forced vertically across the tubes 126 by a suitable air moving device, such as a blower or fan 66. As the air moves across the tubes 126, moisture or water within the air may condense and gather about the tubes 126. As the water from the air continues to condense, the condensate or condensed water may drop along the first or second frame portions 128A, 128B to reach the drain pan 122 positioned vertically below the coil assembly 120. For example, in some embodiments, the drain pan 122 may be coupled to or disposed adjacent to the distal ends 132A, 132B of the first and second framed portions 128A, 128B, or may be coupled to or disposed on a portion of the housing 114. In certain embodiments, air moving device may blow or draw the condensate off of the tubes 126, along the fins, and into the drain pan 122. In other embodiments, the condensate may be pulled by gravity along the fins to reach the drain pan 122.

For the illustrated embodiment, the heat exchanger unit 110 has a vertical orientation, meaning that supply air to be conditioned by the heat exchanger 112 flows vertically (e.g., bottom to top or top to bottom) within the housing 114 during heating or cooling operation. It may be noted that while the present approach is discussed in the context of the vertically-oriented heat exchanger unit 110, in other embodiments, the present approach may also be used for horizontally-oriented heat exchanger units to facilitate the horizontal movement of air through the housing 114. The illustrated housing 114 includes three integrated panels 134 (e.g., panel 134A, 134B, and 134C), which enclose the heat exchanger 112 on three sides and block the escape of the supply air traversing the heat exchanger unit 110 to be heated or cooled. In certain embodiments, the housing 114 may be a unibody housing. In some embodiments, the housing 114 is monolithic, and is fabricated from a single material (e.g., a single sheet of sheet metal).

For the illustrated embodiment, a lower portion 136 of the housing 114 is designed to couple to a portion of the HVAC system 50 (e.g., the housing of a blower unit) to enable air to enter the housing 114 and reach the heat exchanger 112. An upper end 138 of the housing 114 is designed to couple to another portion of the HVAC system 50, such as duct work or an air handling enclosure, to enable the heated or cooled supply air to exit the housing for distribution throughout the structure. Additionally, in some embodiments, a front portion 140 of the heat exchanger unit 110 is designed to removably couple to an access panel 142 (e.g., a sheet metal plate), such that the heat exchanger 112 is enclosed on four sides during operation, with top and bottom sides open to enable vertical air flow through the heat exchanger unit 110. As illustrated, this access panel 142 can be decoupled from the remainder of the housing 114 and removed to inspect or service the heat exchanger 112 after installation of the heat exchanger unit 110. For the illustrated embodiment, panels 134A and 134C are oriented substantially parallel to one another, while panel 134B is oriented substantially orthogonal or perpendicular to panels 134A and 134C and substantially parallel to the access panel 142, when installed. As such, the housing 114 may be described as generally having a rectangular prismatic shape (e.g., a cubic shape) and/or as defining a rectangular or cubic interior volume. Additionally, the panels 134A, 134B, and 134C are integrated to define a C-shaped or U-shaped profile of the housing 114.

Figure 6:
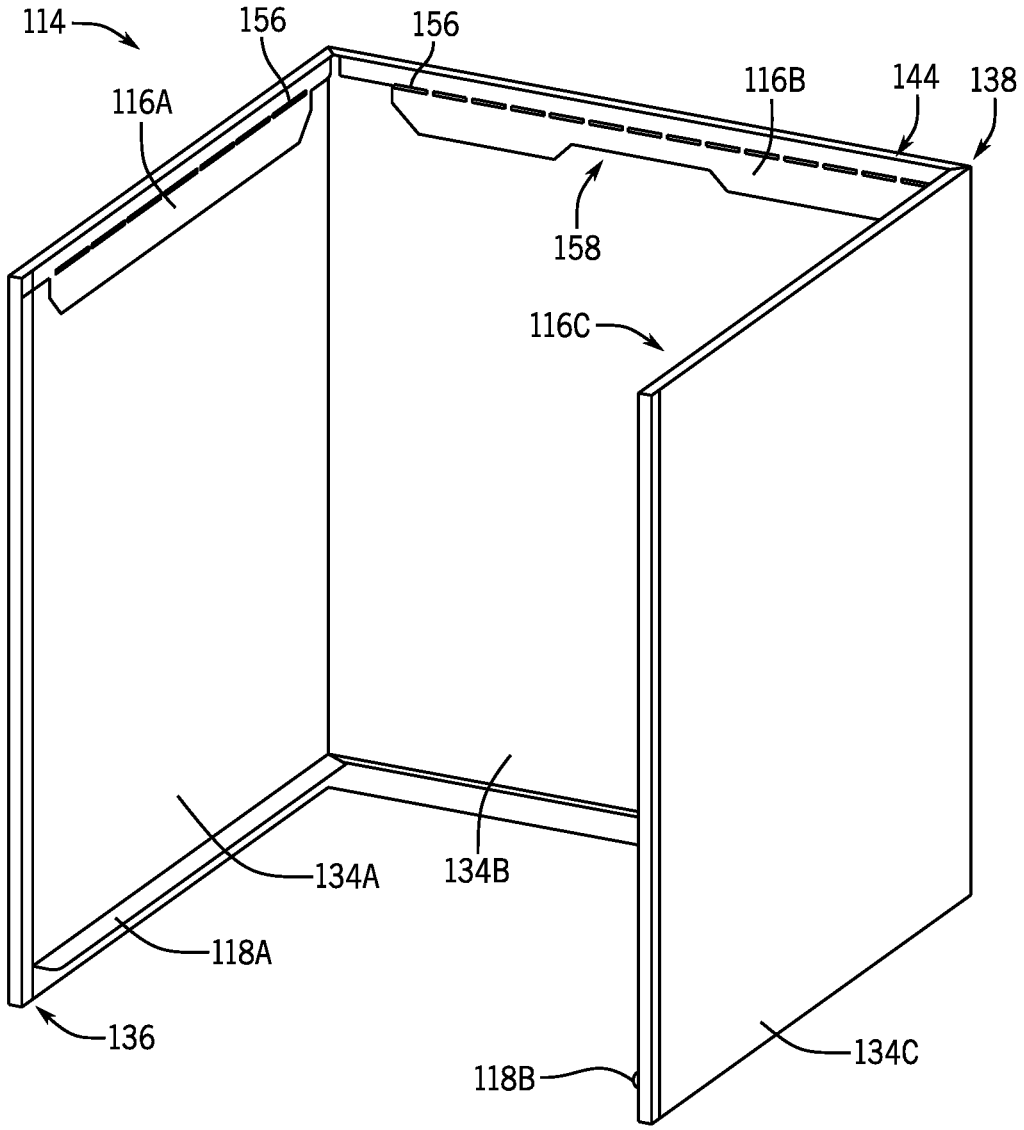
FIG. 6 is a diagram illustrating an embodiment of the housing of the heat exchanger unit of FIG. 4 having attachment flanges in a collapsed configuration, in accordance with present techniques.

For the embodiment of the housing 114 illustrated in FIG. 6, each of the panels 134A, 134B, and 134C includes respective attachment flanges 116A, 116B, and 116C that are integrated into and extend from a top edge 144 of the housing 114 to enable the heat exchanger unit 110 to be coupled to other portions of the HVAC system 50 (e.g., air handling units, ducting). In particular, the attachment flanges 116 of the illustrated housing 114 are moveable or foldable attachment flanges that, as discussed below, are designed to move between an initial collapsed configuration to a final extended or deployed configuration to enable the heat exchanger unit 110 to be fluidly coupled to other portions of the HVAC system 50 during installation. Additionally, for the illustrated embodiment, the attachment flanges 116 extend over the entire width of their respective panels 134. In other embodiments, the attachment flanges 116 may only extend a portion of the width of the panels 134 and/or the attachment flanges 116 may only be integrated into a portion of the panels 134 (e.g., only panels 134A and 134B). In some embodiments, the housing 114 may also include attachment flanges 116 on the lower end 136 of the housing 114 to facilitate coupling the heat exchanger unit 110 between two portions of the HVAC system 50.

For the embodiment illustrated in FIG. 6, the attachment flanges 116 are disposed in a collapsed or undeployed configuration. It is presently recognized that shipping and transporting the housing 114 to the installation location in the collapsed configuration reduces shipping cost and shipping space, as well as reduces the chances of undesirably damaging the attachment flanges 116 prior to installation of the heat exchanger unit 110. In some embodiments, the attachment flanges 116 and their respective panels 134 are integral or monolithic, and both may be formed from a common piece of sheet metal. In other embodiments, the attachment flanges 116 and/or the panels 134 may both be formed from another suitable material.

Figure 7:
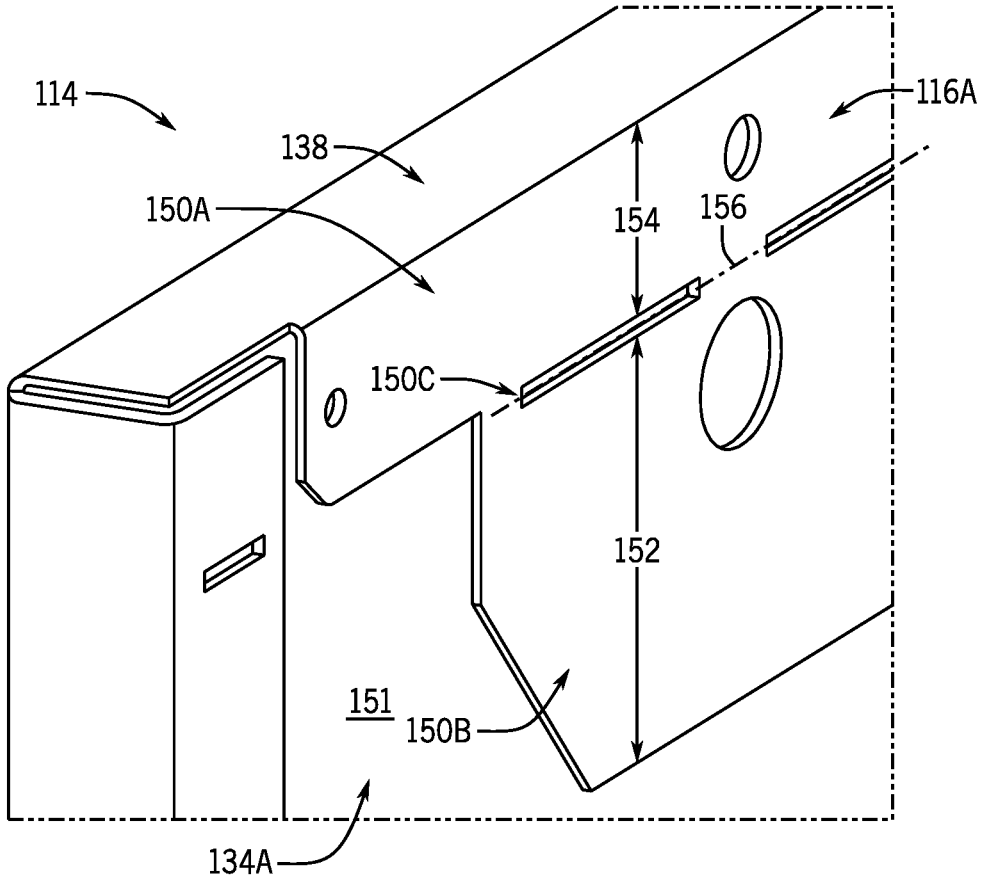
FIG. 7 is a diagram illustrating an enlarged view of an attachment flange of the embodiment of the housing of FIG. 5 in the collapsed configuration, in accordance with present techniques.

FIG. 7 illustrates an enlarged view of an embodiment of the attachment flange 116A of panel 134A of the housing 114 in the collapsed configuration. As illustrated, the attachment flange 116A includes a stationary portion 150A that is oriented substantially parallel to the interior surface 151 of the panel 134A, and that remains in this orientation even after the attachment flanges 116 are deployed, as discussed below. The illustrated attachment flange 116A also includes a moveable portion 150B that is also oriented in line and co-planar with the stationary portion 150A when the attachment flange is in the collapsed configuration. In certain embodiments, the moveable portion 150B of the attachment flange 116A has a vertical dimension 152 that is greater than a vertical dimension 154 of the stationary portion 150A of the attachment flange 116A. It should be note that geometric terminology, such as co-planar, planar, parallel, and so forth should be interpreted as would be generally understood by one of ordinary skill in the art and not in a strict mathematical sense. For example, co-planar refers to a relative orientation that is generally co-planar.

Between the stationary portion 150A and the moveable portion 150B, the illustrated attachment flange 116A includes a flexible or foldable portion 150C, which is designed to fold to deploy the attachment flange 116A for attachment. The foldable portion 150C of the attachment flange 116A defines a fold line 156 about which the moveable portion 150B of the attachment flange 116A is rotated into the deployed or extended configuration. For the embodiment illustrated in FIG. 7, the foldable portion 150C may be scored, slotted, or otherwise modified to enable the moveable portion 150B of the attachment flange 116A to be bent or folded along the fold line 156 into the deployed configuration, for example, using a suitable tool (e.g., pliers). In some embodiments, the attachment flange 116A may include more than one folding line 156 to facilitate selective angular displacement of one or more portions of the attachment flange 116A into the deployed configuration. Additionally, the foldable portion 156 may be designed such that the moveable portion 150B of the attachment flange 116A only displaces in response to a sufficient force being applied, such that the attachment flange 116A is unable to inadvertently switch to the deployed configuration during shipping and transport.

In certain embodiments, the attachment flanges 116 may have rectangular shape, a trapezoidal shaped, a polygonal shaped, or any other suitable geometric or non-geometric shape. In an embodiment, the stationary portion 150A and the moveable portion 150B of the attachment flanges 116 have similar shapes or profiles, while in other embodiments, the stationary portion 150A and the moveable portion 150B have different shapes or profiles. Additionally, in certain embodiments, one or more of the attachment flanges 116 may include one or more openings or cut-out sections 158 (e.g., in the moveable portion 150B), as illustrated in FIG. 6, to avoid abutment with, or to provide adequate space to, equipment (e.g., the heat exchanger 112) disposed within the housing 114 while the attachment flanges 116 are in the collapsed configuration.

Figure 8:
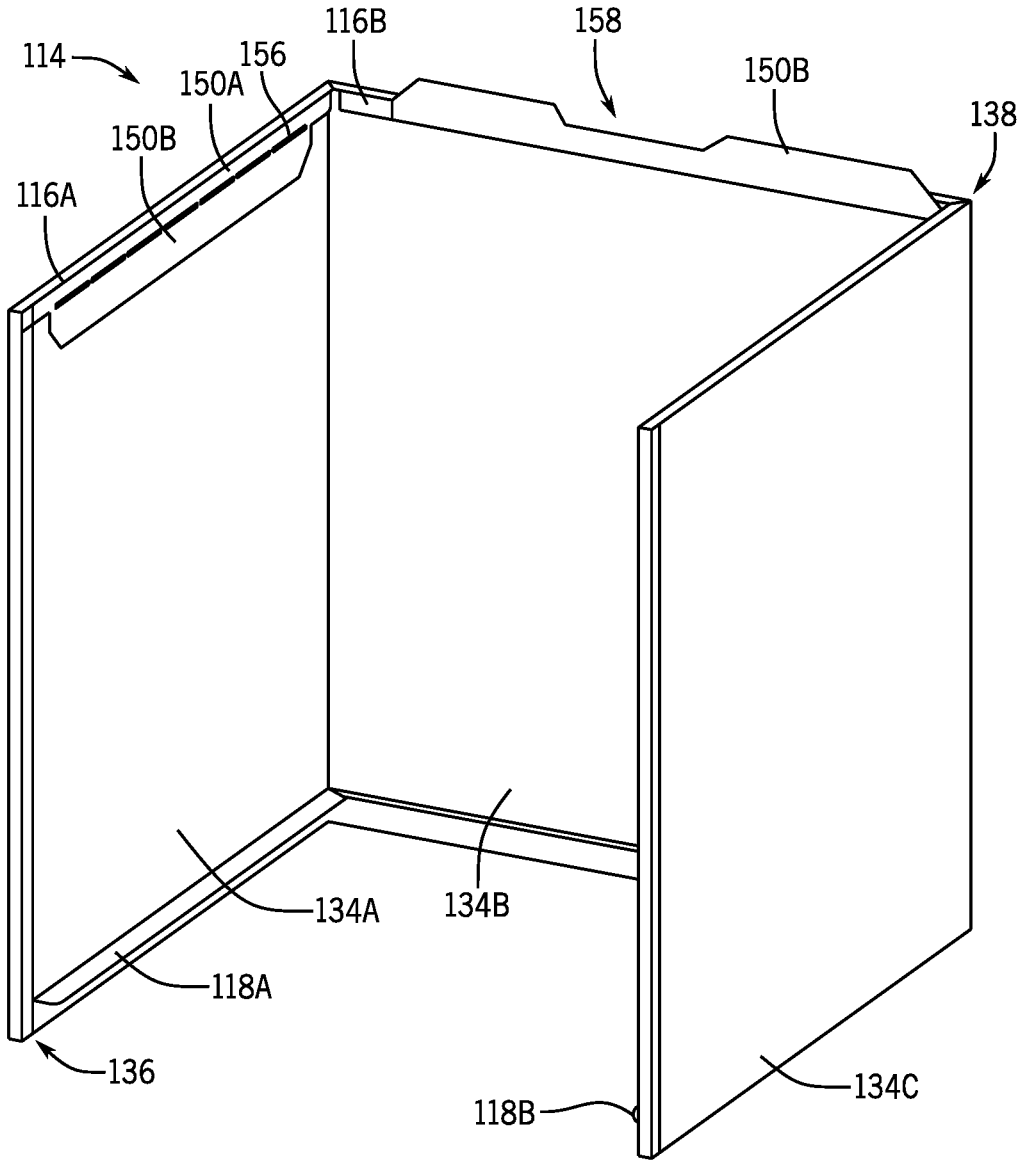
FIG. 8 is a diagram illustrating the embodiment of the housing of FIG. 5 having an attachment flange in a deployed configuration, in accordance with present techniques.

FIG. 8 illustrates an embodiment of the housing 114 in which attachment flange 116B is in the deployed or extended configuration. As such, FIG. 8 demonstrates that, in certain embodiments, one or more of the attachment flanges 116 (e.g., less than all attachment flanges 116 of the housing 114) may be modified to the deployed position during installation to couple the heat exchanger unit 110 to another portion of the HVAC system 50. For example, during installation, the installer may first place the housing 114 adjacent to one or more components of the HVAC system 50 that will be attached to the housing (e.g., an air duct, a blower unit), then may optionally install an internal component of the HVAC system 50 (e.g., the heat exchanger 112) within the housing, and then may deploy one or more attachment flanges to couple the housing 114 to the one or more components of the HVAC system 50. In certain embodiments, the attachment flanges 116 alone may couple the housing 114 to the other component of the HVAC system 50, while in other embodiments, one or more brackets or fasteners may be used to couple the attachment flanges 116 to the other components of the HVAC system for certain applications.

Figure 9:
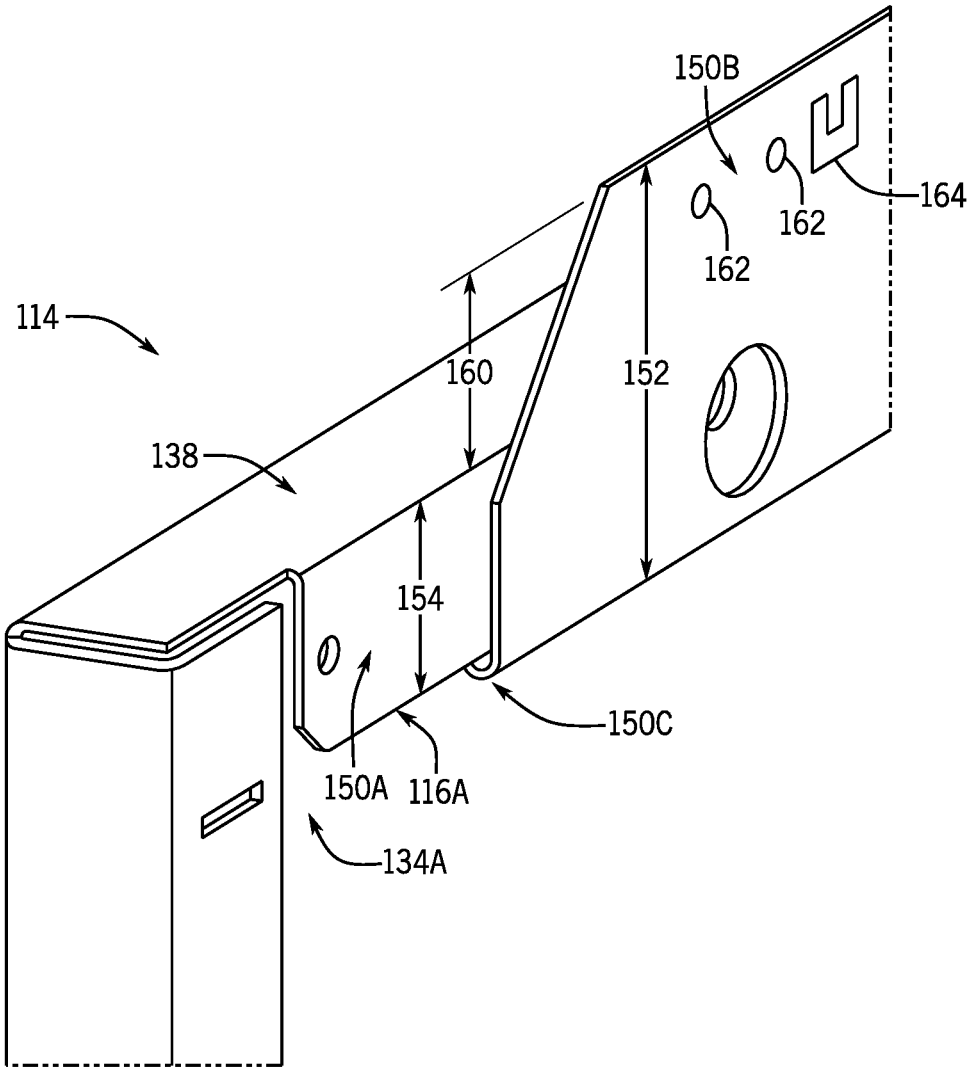
FIG. 9 is a diagram illustrating an enlarged view of an attachment flange of the embodiment of the housing of FIG. 7 in the deployed configuration, in accordance with present techniques.

FIG. 9 illustrates an enlarged view of attachment flange 116A of panel 134A of the housing 114 in the deployed or extended configuration. For the illustrated embodiment, the moveable portion 150B of the attachment flange 116A has been moved into the deployed configuration by folding the foldable portion 150C of the attachment flange 116A along the folding line 156, as discussed above. As noted above, for the illustrated embodiment, the moveable portion 150B of the attachment flange 116A has a vertical dimension 152 that is greater than a vertical dimension 154 of the stationary portion 150A of the attachment flange 116A. As such, in the deployed configuration, the moveable portion 150B extends a distance 160 above the upper edge 138 of the panel 134A to engage with and/or couple to another component of the HVAC system 50. Additionally, in the deployed configuration, the moveable portion 150B is substantially parallel with the stationary portion 150A of the attachment flange 116A, as well as the surface of the integrated panel 134A. However, after deployment, the moveable portion 150B is no longer in-line and co-planar with the stationary portion 150A of the attachment flange 116A.

When one or more of the attachment flanges 116 of a housing 114 are in the deployed configuration, the moveable portion 150B of the deployed attachment flanges 116 are designed to engage with another component of the HVAC system 50 (e.g., a duct, a blower) to fluidly couple the interior volume of the housing 114 to the interior volume of the other component of the system. In some embodiments, one or more fasteners (e.g., screws, bolts) may be used to attach the moveable portion 150B of the deployed attachment flanges 116 to the other component. For example, in certain embodiments, the moveable portion 150B of the deployed attachment flange 116A may include one or more openings 162 that are designed to receive such fasteners. However, in other embodiments, the attachment flanges 116 enable a fastener-free connection between the housing 114 and the other component of the HVAC system 50. For example, in certain embodiments, the one or more openings 162 may instead align with corresponding protrusions or extensions from the housing of the other component, such that the corresponding openings and protrusions mate and couple to form a fastener-free attachment between the components. In some embodiments, the moveable portion 150B of the attachment flanges 116 may include integrated protrusions or extensions that align with, and couple to, corresponding openings in the other component of the HVAC system 50 to form a fastener-free attachment between the components. In certain embodiments, integrated protrusions may be implemented using a pin 164 of the moveable portion 150B that is initially co-planar with the remainder of the moveable portion 150B in the collapsed configuration, wherein the pin 164 is bent out of the plane of the moveable portion 150B (e.g., using pliers) when the attachment flange 116A is deployed, such that the pin 164 extends into a corresponding opening of the other component of the HVAC system 50 to facilitate fastener-free attachment (without any separate bracket or fastener being used). In some embodiments, the moveable portion 150B may not include any such openings or protrusions and may abut an interior surface of the other component of the HVAC system 50 (e.g., with or without an adhesive or sealant applied between) to couple the heat exchanger unit 110 to the other component of the HVAC system 50 without the use of fasteners.

Returning briefly to the embodiment of the housing 114 illustrated in FIG. 6, at least a portion of the panels 134 (e.g., panels 134A and 134C) include a respective support flange 118A, 118C integrated at or near the bottom end 136 of the housing 114 to enable the heat exchanger 112 to be disposed within and supported by the housing 114. In some embodiments, the support flanges 118 and their respective panels 134 are integral or monolithic, and both may be formed from a common piece of sheet metal. In other embodiments, the support flanges 118 and/or the panels 134 may both be formed from another suitable material.

Figure 10:
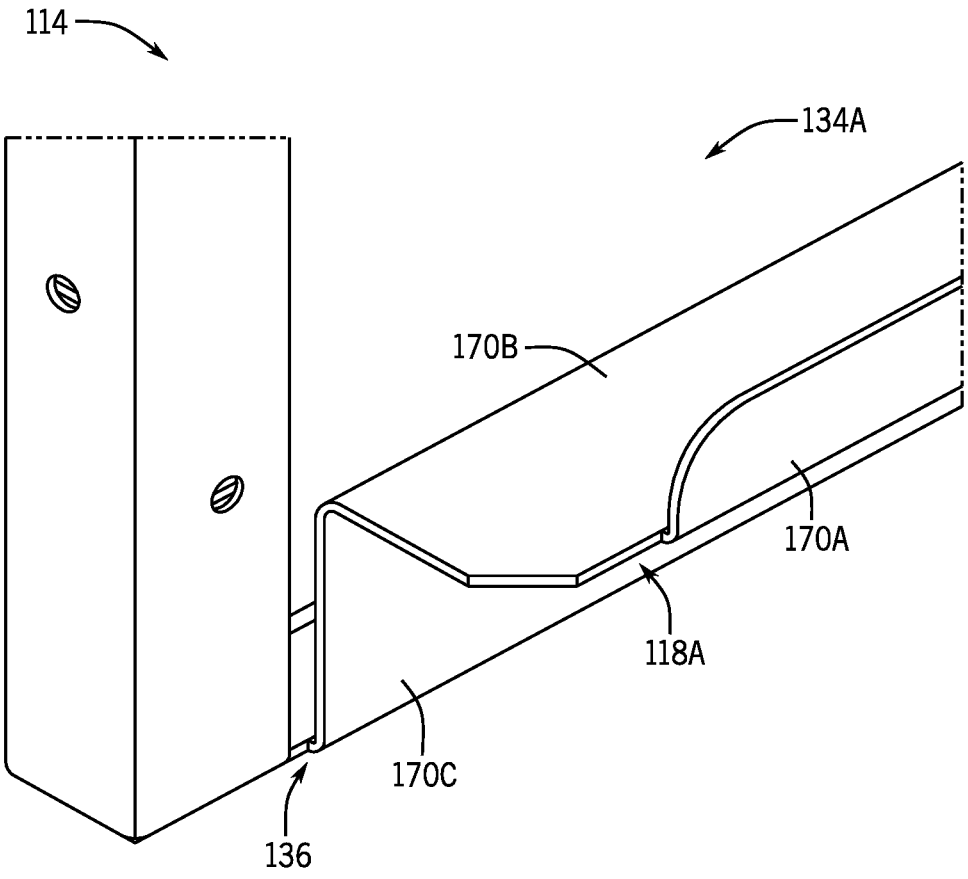
FIG. 10 is a diagram illustrating an enlarged view of the support flange of the embodiment of the housing of FIG. 5, in accordance with present techniques.

FIG. 10 is an enlarged view of the support flange 118A of a panel 134A for an embodiment of the housing 114. For the illustrated embodiment, the support flange 118A includes a first section 170A, a second section 170B, and a third section 170C. More specifically, for the illustrated embodiment, the support flange 118A has a Z-shaped profile, such that first section 170A and third section 170C are substantially parallel, and such that the second section 170B extends between, and is substantially orthogonal to, the first section 170A and the third section 170C. During installation of the heat exchanger unit 110, the heat exchanger 112 is disposed within the housing 114, such that the distal ends 132A, 132B of the heat exchanger 112 rest on the second section 170B of the support flanges 118.

Figure 11:
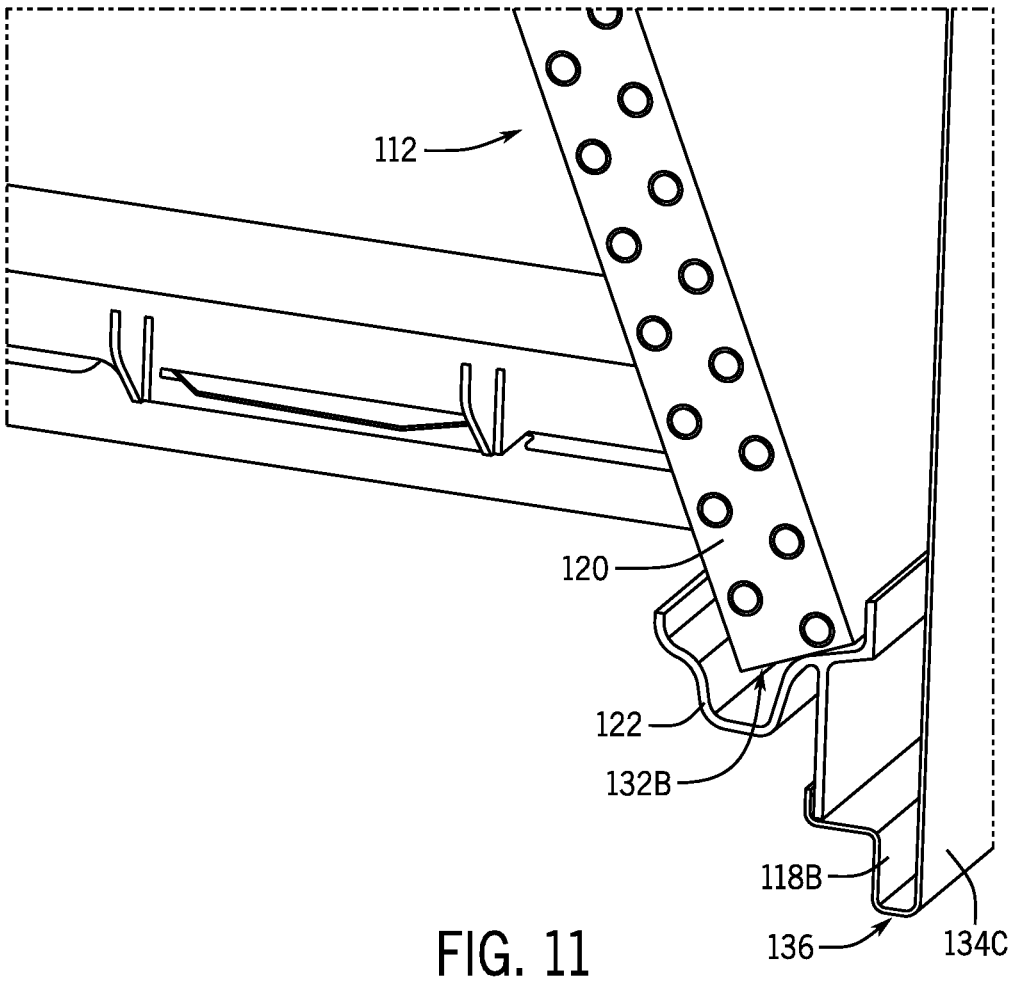
FIG. 11 is a diagram illustrating an enlarged view of the placement of the heat exchanger on the support flanges of the embodiment of the housing of FIG. 9, in accordance with present techniques.

FIG. 11 is an enlarged view of the support flange 118B of a panel 134C for an embodiment of the housing 114. For the illustrated embodiment, the drain pan 122 of the heat exchanger 112 is disposed between the heat exchanger 112 and the support flange 118B, such that the heat exchanger 112 and the drain pan 122 are slidably mounted on and supported by the support flange 118B. It may be appreciated that this enables the installer to more easily slide the drain pan 122 and the heat exchanger 112 into position within the housing 114 during installation, as well as more easily access the heat exchanger 112 during inspection and maintenance. Once the heat exchanger 112 is slid into position, the distal end 132B of the coil assembly 120 rests on the drain pan 122, which is in turn supported by the support flange 118B of the housing 114. In some embodiments, the heat exchanger 112 is not fastened to the support flanges using fasteners, which may enable the installation of certain embodiments of the heat exchanger unit 110 without the use of fasteners.

Figure 12:
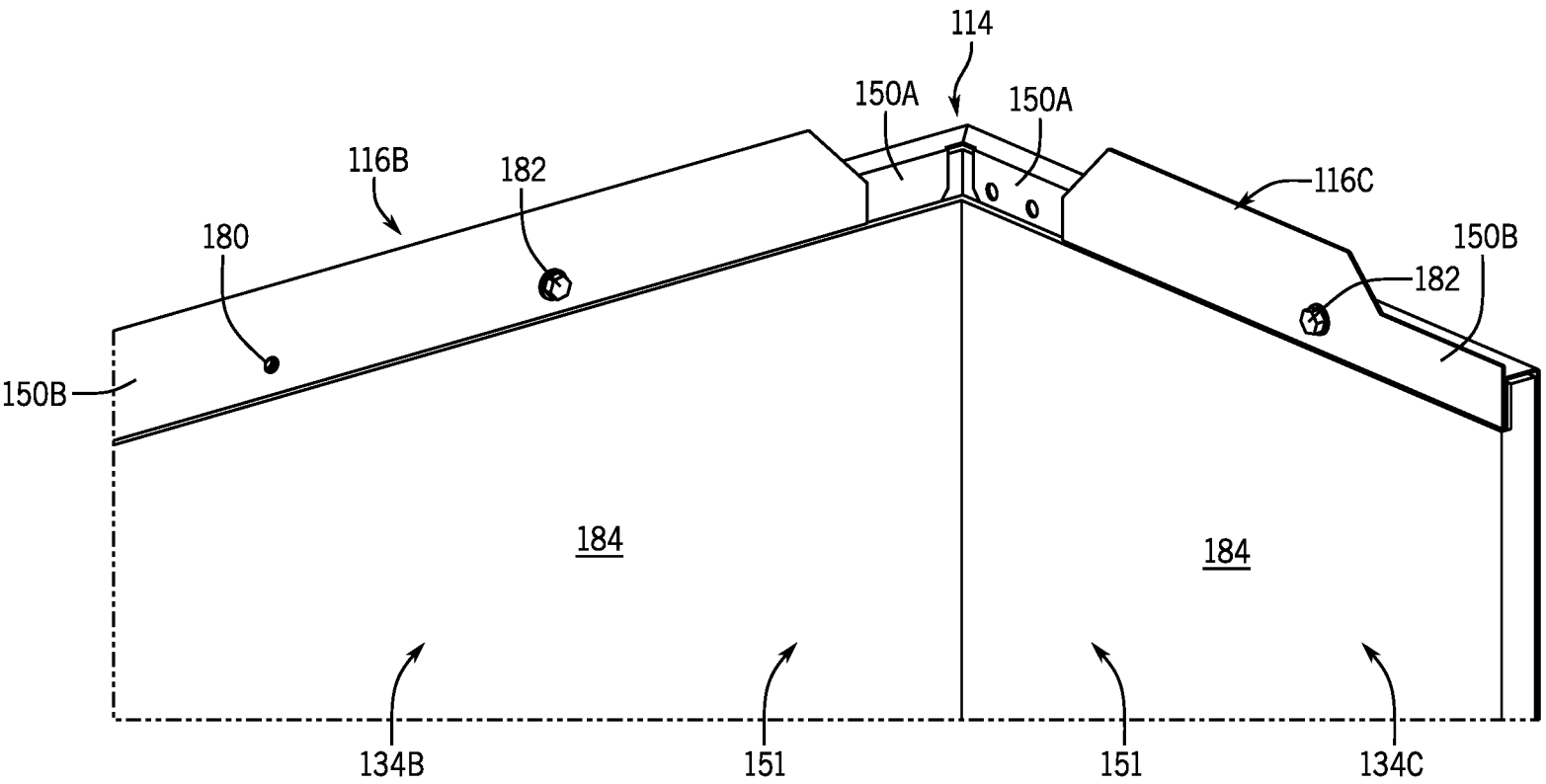
FIG. 12 is a diagram illustrating an enlarged view of an embodiment of the housing having two attachment flanges in the deployed configuration, in accordance with present techniques.

FIG. 12 is a diagram illustrating an enlarged view of an embodiment of the housing 114 having attachment flanges 116B and 116C in the deployed configuration. For the illustrated embodiment, the movable portions 150B of the attachment flanges 116B, 116C include openings 180 (e.g., holes or slots) that are designed to receive suitable fasteners 182 (e.g., sheet metal screws) to couple the movable portions 150B of the attachment flanges 116B and 116C to panels 134B and 134C, respectively, after deployment. It may be appreciated that this generally increases the rigidity of the housing 114 as the installer is fastening the other component of the HVAC system, such as duct work, to the housing 114. In certain embodiments, an insulation material 184 (e.g., a fibrous insulation material) may be disposed on the interior surfaces 151 of the panels 134 to reduce heat transfer between the interior and exterior of the housing 114. In some embodiments, the insulation material 184 may be installed during manufacturing or installation of the housing 114 by tucking the insulation material 184 below the stationary portions 150A of the attachment flanges 116, such that the stationary portions 150A of the attachment flanges 116 secure the insulation material 184 to the interior surfaces 151 of the housing 114. Since this attachment method secures the insulation material 184 to the interior surfaces 151 of the housing 114 without puncturing or otherwise disturbing the body of the insulation material 184, such embodiments may enable fibers within the interior of the insulation material 184 to be desirably isolated from the supply air flow traversing the housing 114. Meanwhile, the deployed movable portions 150B of the attachment flanges 116 act as integrated duct flanges that engage with, and/or are fastened to, the duct work, which obviates the need for a separate bracket or flange.

The technical effects of the present disclosure include a housing for a component (e.g., a heat exchanger) of a HVAC system that includes one or more attachment flanges and/or one or more support flanges that are integrated into the housing. As such, present embodiments reduce or completely eliminate the use of separate brackets and fasteners when installing components within the housing and/or when coupling the housing to other components of the HVAC system. By dramatically reducing or eliminating these separate components, present embodiments reduce the likelihood for installation errors, as well as delays due to misplaced brackets and/or fasteners during installation. Accordingly, the disclosed housing designs enable a cost-effective solution for reducing the cost and complexity of installing HVAC system components.

The invention claimed is:

1. A method of installing a housing of a heating, ventilation, and/or air conditioning (HVAC) unit, the method comprising:

positioning the housing adjacent to a component of the HVAC unit, wherein the housing comprises a plurality of integrated panels, and wherein a first panel of the plurality of integrated panels comprises an integrated attachment flange that is integrated into an edge of the first panel of the plurality of integrated panels and is initially disposed within an internal volume of the housing in a collapsed configuration, and wherein the integrated attachment flange is parallel to the first panel of the plurality of integrated panels in the collapsed configuration; and folding a foldable portion of the integrated attachment flange to dispose the integrated attachment flange in a deployed configuration, wherein, in the deployed configuration, at least part of a moveable portion of the integrated attachment flange extends beyond the edge of the first panel of the plurality of integrated panels to engage the component of the HVAC unit.

2. The method of claim 1, wherein after positioning the housing, the method comprises:

slideably mounting a heat exchanger onto support flanges of the housing before folding the foldable portion of the integrated attachment flange.

3. The method of claim 1, wherein after folding the foldable portion of the integrated attachment flange, the method comprises:

attaching a portion of the integrated attachment flange to the component of the HVAC unit using one or more brackets or fasteners.

4. The method of claim 1, wherein folding the foldable portion of the integrated attachment flange comprises bending the foldable portion of the integrated attachment flange using pliers.

* * * * *